US005470023A

United States Patent [19]

Falkner

[11] Patent Number: 5,470,023

[45] Date of Patent: Nov. 28, 1995

[54] CRUSHING APPARATUS FOR WASTE MATERIAL

[75] Inventor: Raimund Falkner, Roppen, Austria

[73] Assignee: Agria-Werke GmbH, Möckmühl, Australia

[21] Appl. No.: 244,577

[22] PCT Filed: Dec. 11, 1992

[86] PCT No.: PCT/AT92/00166

§ 371 Date: Jun. 1, 1994

§ 102(e) Date: Jun. 1, 1994

[87] PCT Pub. No.: WO93/11873

PCT Pub. Date: Jun. 24, 1993

[30] Foreign Application Priority Data

Dec. 12, 1991 [DE] Germany ..... 9115433 U

[51] Int. Cl.[6] ..... B02C 4/08

[52] U.S. Cl. ..... 241/85; 241/87; 241/236; 241/261

[58] Field of Search ..... 241/236, 261, 241/74, 93, 85, 87

[56] References Cited

U.S. PATENT DOCUMENTS

| | | | |
|---|---|---|---|
| 1,327,254 | 1/1920 | Remmers | 241/85 X |
| 2,778,482 | 1/1957 | Lasch et al. | 241/236 |
| 2,833,481 | 5/1958 | Perks | 241/85 X |
| 3,473,714 | 10/1969 | Woody | 225/97 |
| 3,664,592 | 5/1972 | Schweigert et al. | 241/236 |
| 3,862,721 | 1/1975 | Flair | 241/236 |
| 4,121,524 | 10/1978 | Voelskow | 110/220 |
| 4,738,402 | 4/1988 | Downie | 241/93 X |
| 5,156,872 | 10/1992 | Lee | 426/489 |
| 5,306,131 | 4/1994 | Brotz | 241/85 X |
| 5,364,037 | 11/1994 | Bigelow | 241/93 |

FOREIGN PATENT DOCUMENTS

| | | |
|---|---|---|
| 497045 | 11/1919 | France . |
| 753030 | 10/1933 | France . |
| 2466281 | 4/1981 | France . |
| 3819654 | 12/1989 | Germany . |
| 3910115 | 10/1991 | Germany . |
| 9109063 | 11/1991 | Germany . |

*Primary Examiner*—Mark Rosenbaum
*Assistant Examiner*—John M. Husar
*Attorney, Agent, or Firm*—Wenderoth, Lind & Ponack

[57] ABSTRACT

A crushing apparatus for waste material comprising a housing and a drive shaft for driving counter-rotating rollers which mesh with each other and which are hollow and open at one end. The rollers are fitted with cutter elements spaced at intervals around the outside and have cavities between the cutter elements that open into the hollow interior of the rollers.

37 Claims, 3 Drawing Sheets

CRUSHING APPARATUS FOR WASTE MATERIAL

BACKGROUND OF THE INVENTION

1. Field of the Invention

The present invention relates to a crushing apparatus for waste material that comprises a drive, a housing having a filling opening, and a rotary crushing drum which has peripheral cutting bars and which cooperates as a counterpart cutting tool.

2. State of the Prior Art

A crushing apparatus of the kind in which a counterpart cutting tool is a stationary counterpart blade is known, for example, from DE-U-91 09 063. In order to prevent intermediate spaces between the cutting elements of the tool from filling with material, the apparatus has a clearing spatula member which, when coupled to a drum drive of the apparatus, continuously engages with respective intermediate spaces and cleans out the spaces.

Crushing apparatuses in which a counterpart cutting tool is formed by a crushing drum are also already know. The crushing drum can be formed from crushing disks that are fitted with canine teeth and that are arranged with a spacing relative to each other on drive shafts. It is, however, also possible to use one-piece crushing drums on which cutting elements or teeth are provided in axially spaced relationship. Examples of both constructions are to be found in AT-B-350 988.

A problem in all waste crushers or grinders is that the waster materials which are to be reduced in size are of different properties so that the crushing apparatuses are only more or less satisfactory in function. It repeatedly happens that, in spite of a possible reversal of the drive, and in spite of clearing elements which engage with the intermediate spaces, the material is poorly crushed or reduced in size, and becomes jammed. The apparatus must then be at least partially dismantled to clean it out.

FR-A 753.030 describes a kneading mill for swollen corn, FR-A 497.045 describes a device for shredding a field crop, and FR-A 2466 281 describes a device for producing small pieces of tomato pulp. Each of the three devices comprises screening drums provided with bars which engage one another and have to strain a material, which then exits the ends of the screening drums. Passage of the material between the screening drums is not possible, because the housing below the drums is closed.

SUMMARY OF THE INVENTION

The object of the present invention is, therefore, that of improving the operational reliability of such a crushing apparatus, and in particular providing additional free spaces in which material that has not been reduced in size, or which is only poorly reduced in size, can issue in order to prevent blockage of the apparatus.

In accordance with the present invention, a crushing drum is of a hollow configuration and has at least one open end. Between cutting bars are entry slots that are open into the drum cavity to form squeeze-passages for non-crushed or insufficiently crushed material. In this way the material cannot become fixed between the cutting bars and clog the bars, but is further urged into the drum cavity by subsequent material.

Preferably, a counterpart cutting tool is formed by a second crushing drum which rotates in an opposite relationship to the first crushing drum and which has peripheral cutting bars which engage with the cutting bars of the first crushing drum. In this case, the second crushing drum is also of a hollow configuration and has at least one open end. Entry slots are open into the drum cavity of the second crushing drum between the cutting bars.

The cutting bars may extend in both a parallel relationship to the axis and also in an inclined relationship to the axis. The entry slots preferably increase in size as they extend into the drum cavity so that the material cannot become jammed.

When the drums are in a non-horizontal position, the material which penetrates into the drum cavities issues downwardly therefrom under the effect of the force of gravity through the openings in the ends of the drums. Preferably provided in each drum cavity, however, is a cleaning element which acts on the material towards the open end so that positive emptying occurs irrespective of the position of the crushing drums. Depending on the degree to which the material from the drum cavity is crushed or reduced in size, the material is returned into the crushing apparatus for further crushing, or it is added to the material which has already been crushed by the drums.

Because the drums rotate, the clearing element can be arranged in fixed relationship with the housing. The clearing element of this kind projects, at least at one end thereof, out of the drum cavity, and is fixed on the outside to the housing, in particular by means of a mounting plate or the like. In a first embodiment, the clearing element comprises a plate which is curved in conformity with the drum and arranged in the drum cavity either at or without a spacing relative to the inside of the drum, and either in a parallel relationship or in an inclined position with the axis and operative in one or both directions of rotation. In a preferred embodiment the plate is of a trapezoidal shape that extends over approximately a third of the periphery, and at the narrow side of which the mounting plate is disposed. The inclined sides of the plate form cleaning edges, along which the material is discharged by virtue of the rotary movement of the drum, and they can also further act as cutting edges which shear off the material which penetrates through the intermediate spaces at the inside of the drum and thus reduce the material in size.

Instead of a plate which is fixed with respect to the housing, a web which is wound in a helical configuration, for example a portion of a conveyor screw, may also be arranged in the drum cavity as the clearing element. The conveyor screw is preferably also fixed with respect to the housing, but it is also possible to envisage it being driven.

A further embodiment provides that the second end of the crushing drum is closed by a cover means. As the two drums, or the cutting bars thereof, positively lockingly engage with each other in the peripheral direction, a further preferred embodiment provides that the drive is associated with only one crushing drum. In this case it is further advantageous if the cutting bars of the driven crushing drum are wider than the cutting bars of the second crushing drum.

BRIEF DESCRIPTION OF THE DRAWINGS

Two preferred embodiments of the invention are described in greater detail hereinafter with reference to the Figures of the accompanying drawings, but without being restricted thereto. In the drawings.

DETAILED DESCRIPTION OF THE PREFERRED EMBODIMENTS

Figure 1:
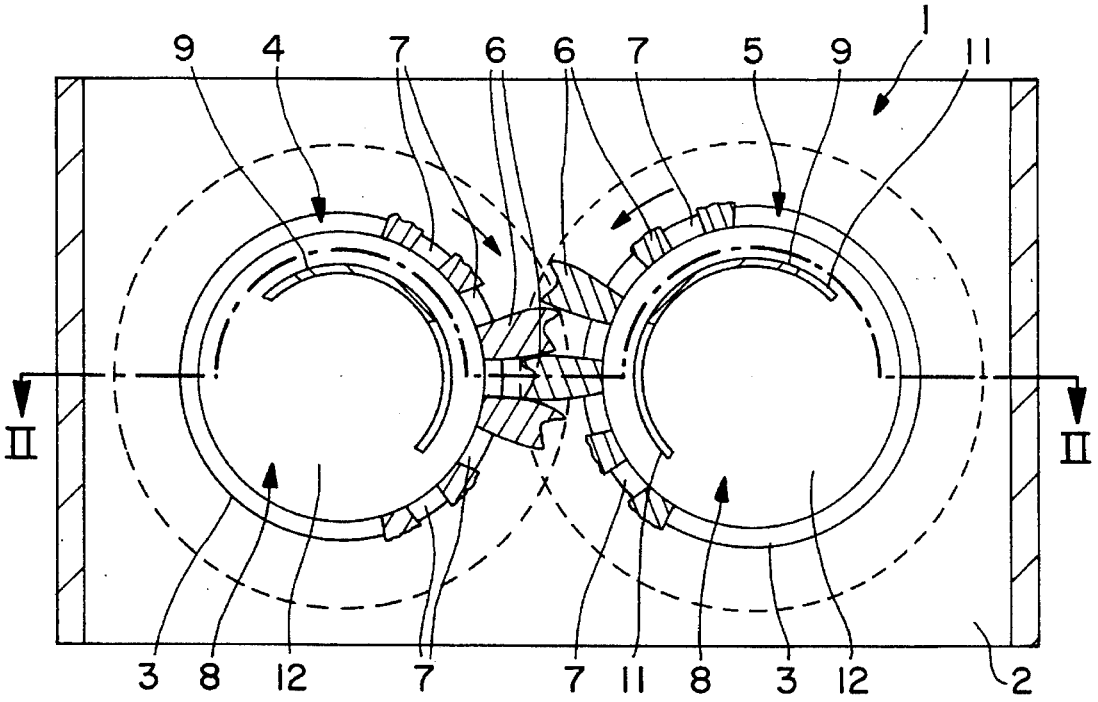
FIG. 1 is a view in section taken along line I—I of FIG. 2, of a crushing apparatus of a first preferred embodiment of the present invention.
Figure 2:
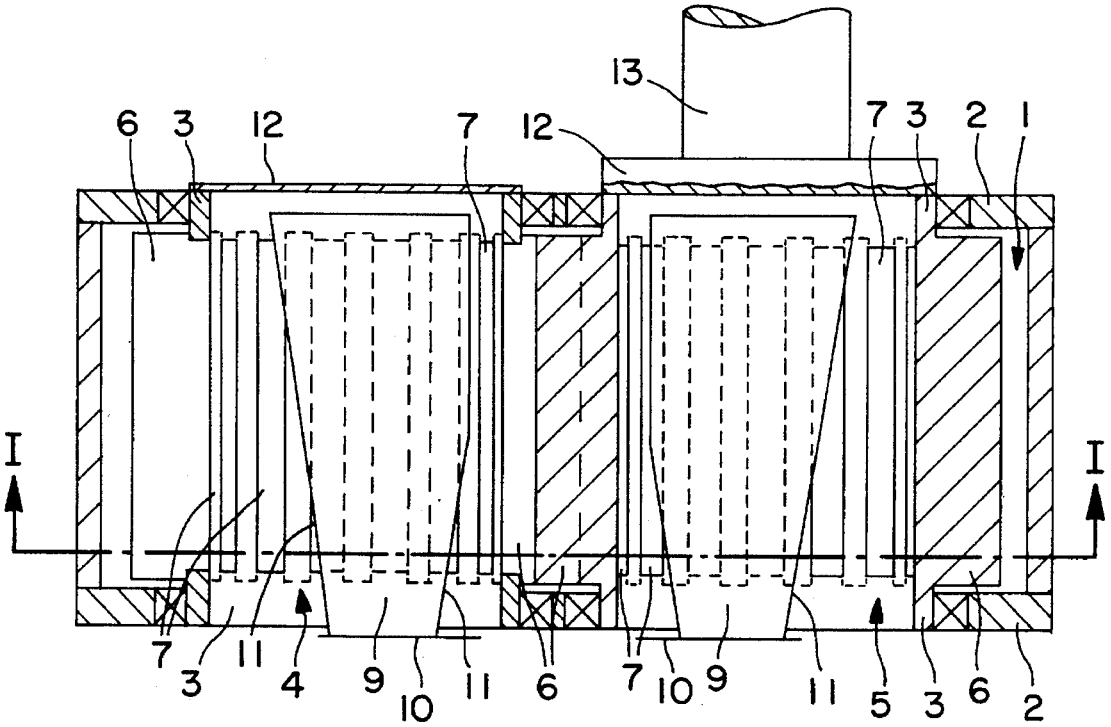
FIG. 2 is a view in section, taken along line II—II of FIG. 1.
Figure 3:
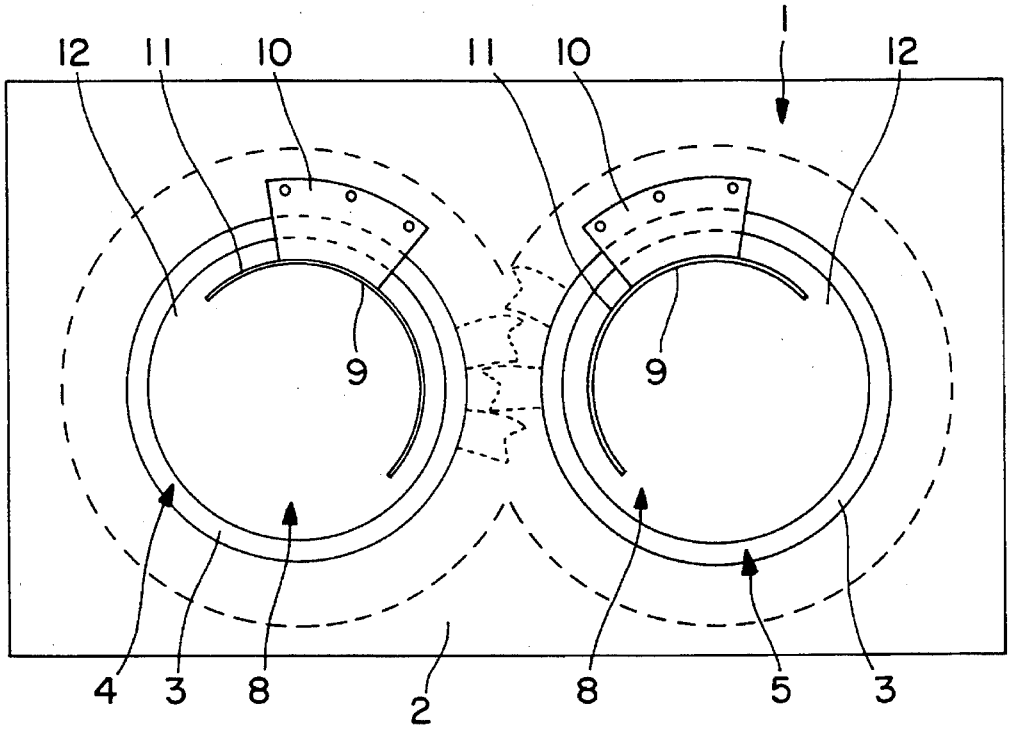
FIG. 3 is an end view of the crushing apparatus shown in FIGS. 1 and 2.

A crushing apparatus according to the invention has a rectangular housing 1 having four side walls 2. Two crushing drums 4 and 5 are of a hollow and cylindrical configuration and are rotatably supported with end mounting portions 3 in mutually oppositely disposed side walls 2. The mounting portions 3 may be formed, for example, by rings which are grooved at their periphery and into which are interchangeably inserted longitudinal bars which are stepped at their ends. Between the mounting portions 3, the two crushing drums 4 and 5 are provided with spaced-apart longitudinal webs or bars which project beyond the periphery of the mounting portions 3. The longitudinal bars form cutting bars 6 and 15 and 16 that have cutting edges for waste material to be cut up. The cross-sections of the cutting bars correspond to those of canine teeth. The cutting bars 6 and 16 of the one drum 4 engage with the intermediate spaces between the cutting bars 6 and 16 of the second drum 5 so that there is a gear wheel-like engagement between the two crushing drums 4 and 5. It is therefore sufficient for a drive 13 to be associated only with the drum 5. The intermediate spaces between the longitudinal bars are open into a drum cavity 8. That is, the cutting bars 6, and 15 and 16, are separated from each other by entry slots 7. Material which is engaged by the cutting bars is crushed and reduced in size as it passes through between the two crushing drums 4 and 5, and drops downwardly. Material which has not been crushed, or which has only been partially crushed, and which could fill the intermediate spaces between the longitudinal bars, and thus adversely affect operation of the crushing apparatus, is urged into the drum cavities 8 through the entry slots 7. The entry slots 7 increase in width in an inward direction in order for the material to pass more easily therethrough. Arranged in each drum cavity 8, in a fixed relationship with the housing, is a clearing element 9 which, in the embodiment shown in FIGS. 1 to 3, is formed, for example, as a trapezoidal curved plate. The plates can extend in such a way as to bear against the inside of the drums 4 and 5, or so as to be at a spacing with the inside of the drums 4 and 5 in a parallel relationship with or in a slightly inclined relationship with, the drum axis. Inclined sides 11 of the plate form, for each direction of rotation, a cutting edge that can shear off or cut up material which enters through the entry slots 7 and, at the same time, a clearing edge along with the material is conveyed outwardly out of the drum cavity 8. The plates project out of their drum cavities 8 at one end thereof and are fixed to the outside of the housing wall 2 by means of mounting plates 10. Provided at the side of each drum 4 and 5 that is in an opposite relationship to the material discharge side is a cavity cover means 12, which at the driven crushing drum 5 is formed by a drive flange connected to the mounting portion 3 thereof.

Each cleaning plate 9 can extend over an angle of about between 60° and 300° and over any angular region. In the construction shown in the Figures, the arrangement of the cleaning plates 9 in the respective upper regions of the drums 4 and 5 prevents material which has not been fed to the cutting assembly from penetrating into the drum cavities 8.

Figure 4:
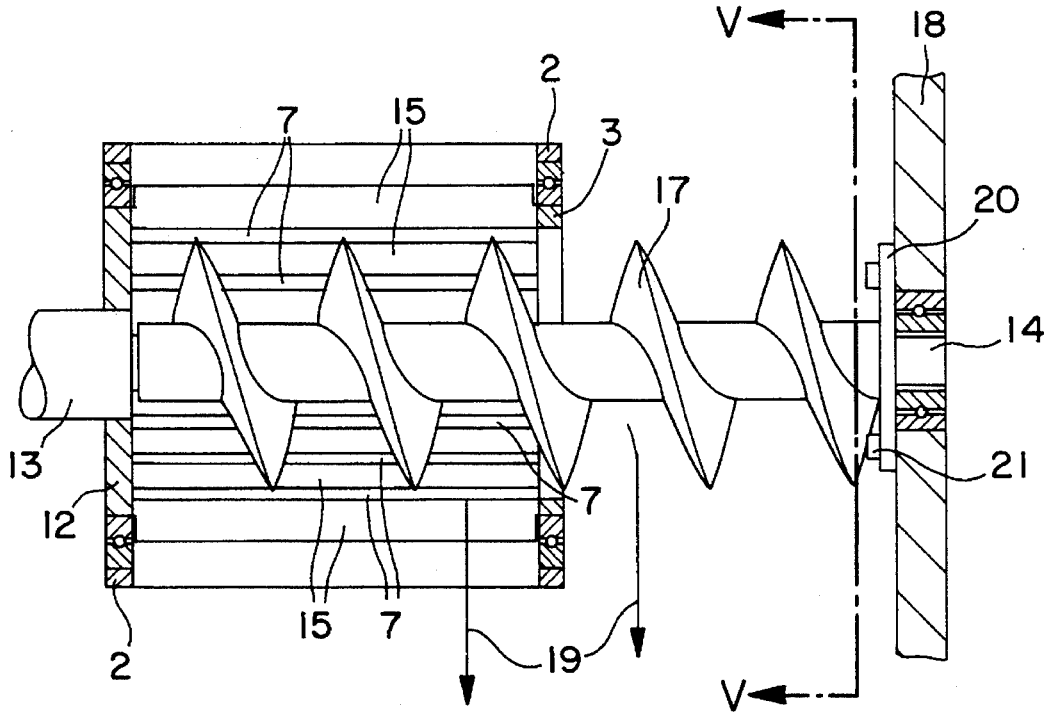
FIG. 4 is a view in longitudinal section, taken along line IV—IV of FIG. 5, of a second preferred embodiment of the present invention.
Figure 5:
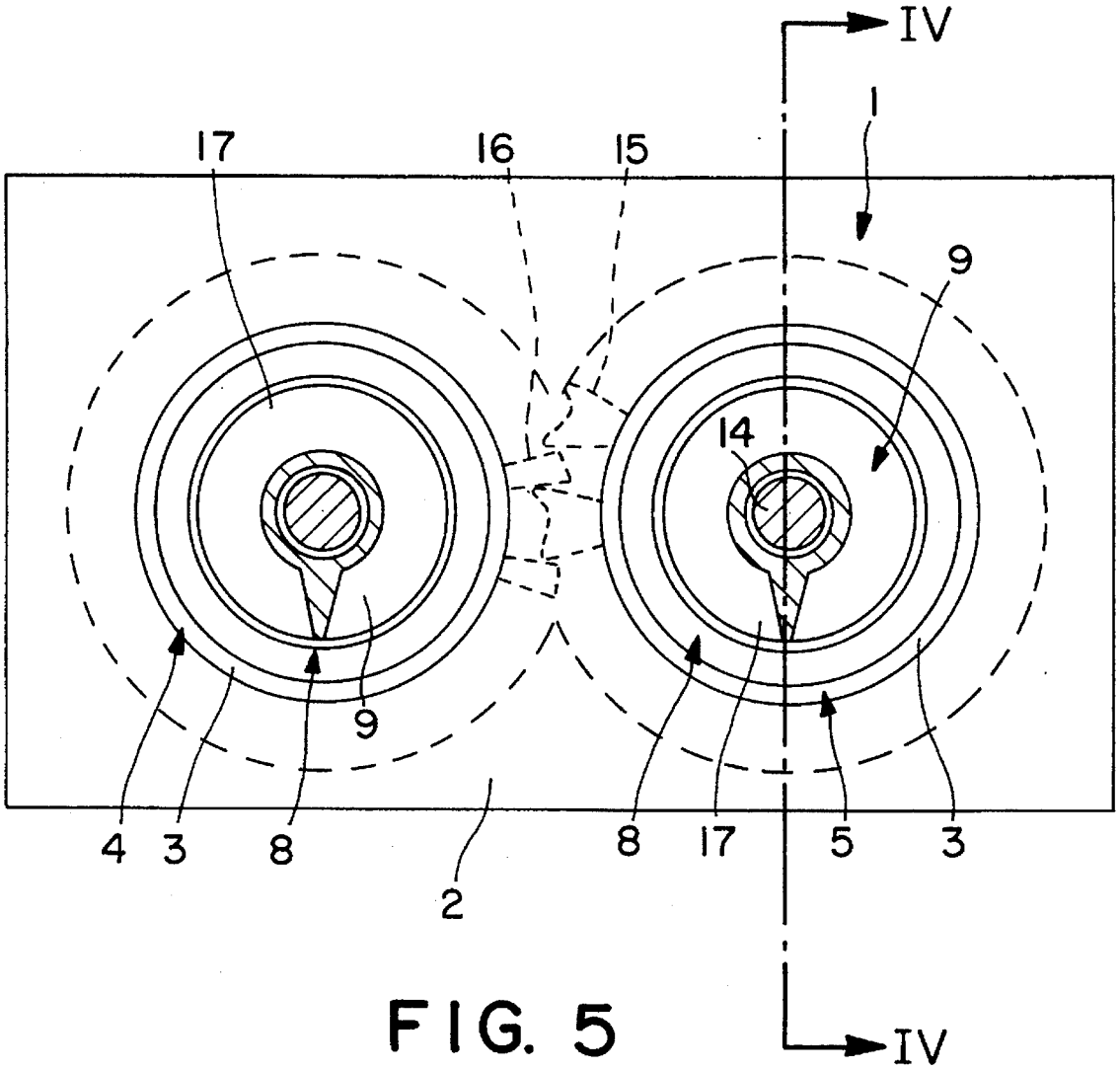
FIG. 5 is a view in section taken along line V—V of FIG. 4.

In the embodiment shown in FIGS. 4 and 5, the clearing element 9 is formed by a stationary conveyor screw 17 which has a plate-like mounting portion 20. The latter is fixed by means of screws 21 to a further housing wall 18 arranged at a spacing relative to the housing walls 2. Passing through the conveyor screw 17 is a shaft 14 that is mounted in the housing wall 18 and connected to the cover means 12. This configuration provides an additional mounting for the crushing drums 4 and 5 and also support for the conveyor screws 17 in the interior of the drums 4 and 5. Due to the rotary movement of the drums 4 and 5, the material passing therethrough is conveyed outwardly along the helical surfaces of the conveyor screws. At the outside the material drops downwardly (arrows 19), like material crushed between the drums 4 and 5. A partitioning wall (not shown) can keep the two portions of material separate from each other so that the portion of material which comes from the drum cavities can possibly be re-introduced into the crushing apparatus if the pieces thereof are still too coarse.

A separate drive for the conveyor screw 17 is also possible. Instead of the screw it is also possible to provide a strip which is wound in a helical configuration and extends around the shaft 14 and which, by virtue of its coil spring like configuration, is also axially movable, whereby it is possible to afford an improved clearing action.

In a construction (not shown) with one crushing drum and a stationary counterpart blade, the single crushing drum is of a similar configuration. It also has a cavity and is open at least at one end, and in this case also a clearing element cleans out material which is pressed into the cavity.

I claim:

1. A crushing apparatus for crushing waste material, said apparatus comprising:

a housing having a filling opening;

a hollow rotary crushing drum within said housing, said crushing drum having a drum cavity and at least one open end, and said crushing drum being provided with peripheral cutting bars spaced apart by entry slots open into said drum cavity;

a drive to rotate said crushing drum; and a counterpart cutting tool cooperating with said cutting bars of said crushing drum, so that waste material is crushed when passing through between said crushing drum and said counterpart cutting tool, and wherein said slots form additional passages for non-crushed or only partially crushed waste material to pass into said drum cavity;

wherein said housing forms an open space below said crushing drum and said counterpart cutting tool allowing waste material that is crushed when passing through between said crushing drum and said counterpart cutting tool to fall therethrough.

2. A crushing apparatus as set forth in claim 1, wherein each entry slot increases in size in a radial direction of said crushing drum towards said drum cavity.

3. A crushing apparatus as set forth in claim 1, wherein each cutting bar has a width and each entry slot has a width approximately corresponding to said width of said cutting bar.

4. A crushing apparatus as set forth in claim 1, wherein said crushing drum is a first crushing drum and said counterpart cutting tool comprises a second crushing drum rotating in opposite relationship to said first crushing drum, said second crushing drum being provided with peripheral cutting bars which engage with said cutting bars of said first crushing drum.

5. A crushing apparatus as set forth in claim 4, wherein said drive is associated with said first crushing drum only.

6. A crushing apparatus as set forth in claim 4, wherein said cutting bars of said first crushing drum are wider than said cutting bars of said second crushing drum.

7. A crushing apparatus as set forth in claim 4, wherein said second crushing drum has a second drum cavity and at least one open end, said peripheral cutting bars of said second crushing drum being spaced apart by entry slots open into said second drum cavity.

8. A crushing apparatus as set forth in claim 7, wherein each said entry slot increases in size in a radial direction of said second crushing drum towards the respective said drum cavity.

9. A crushing apparatus as set forth in claim 7, wherein each cutting bar has a width and each entry slot has a width approximately corresponding to said width of said cutting bar.

10. A crushing apparatus as set forth in claim 7, further comprising clearing means provided in said drum cavity of at least one of said first and second crushing drums operative to clear non-crushed or only partially crushed material toward said open end thereof.

11. A crushing apparatus as set forth in claim 10, wherein said clearing means comprises a plate which is curved parallel to the periphery of the respective said crushing drum and which has at least one clearing edge which is operative towards said open end thereof.

12. A crushing apparatus as set forth in claim 10, wherein said clearing means comprises a helically wound web.

13. A crushing apparatus as set forth in claim 10, wherein said clearing means projects out of the respective said drum cavity and is fixed to said housing.

14. The crushing apparatus as set forth in claim 1, further comprising clearing means provided in said drum cavity operative to clear non-crushed or only partially crushed material towards said open end.

15. A crushing apparatus as set forth in claim 14, wherein said clearing means projects out of said drum cavity and is fixed to said housing.

16. A crushing apparatus as set forth in claim 14, wherein said caring means comprises a plate which is curved parallel to the periphery of said crushing drum and which has at least one clearing edge which is operative towards said open end.

17. A crushing apparatus as set forth in claim 14, wherein said clearing means comprises a helically wound web.

18. A crushing apparatus for crushing waste material, said apparatus comprising:

a housing having a filling opening;

a hollow rotary crushing drum within said housing, said crushing drum having a drum cavity and at least one open end, and said crushing drum being provided with peripheral cutting bars spaced apart on a periphery of said crushing drum;

a drive to rotate said crushing drum; and a counterpart cutting tool cooperating with said cutting bars of said crushing drum, wherein said rotary crushing drum and said counterpart cutting tool together define a means for receiving waste material that is filled into said filling opening of said housing, crushing at least some of the waste material between said cutting bars and said counterpart cutting tool, passing the crushed waste material through between said crushing drum and said counterpart cutting tool, and passing waste material that is not crushed or only partially crushed into said drum cavity.

19. The crushing apparatus of claim 18, wherein said means comprises an open space below said crushing drum and said counterpart cutting tool for allowing the waste material that is crushed and passed through between said crushing drum and said counterpart cutting tool to fall therethrough.

20. The crushing apparatus of claim 19, wherein said means further comprises entry slots in said hollow rotary crushing drum open into said drum cavity and located between said peripheral cutting bars.

21. A crushing apparatus as set forth in claim 20, wherein each entry slot increases in size in a radial direction of said crushing drum towards said drum cavity.

22. A crushing apparatus as set forth in claim 20, wherein each cutting bar has a width and each entry slot has a width approximately corresponding to said width of said cutting bar.

23. The crushing apparatus of claim 19, further comprising clearing means provided in said drum cavity for clearing the non-crushed or only partially crushed material towards said open end of said drum cavity.

24. A crushing apparatus as set forth in claim 18, wherein said crushing drum is a first crushing drum and said counterpart cutting tool comprises a second crushing drum rotating in opposite relationship to said first crushing drum, said second crushing drum being provided with peripheral cutting bars which engage with said cutting bars of said first crushing drum.

25. A crushing apparatus as set forth in claim 24, wherein said drive is associated with said first crushing drum only.

26. A crushing apparatus as set forth in claim 24, wherein said cutting bars of said first crushing drum are wider than said cutting bars of said second crushing drum.

27. A crushing apparatus as set forth in claim 24, wherein said second crushing drum has a second drum cavity and at least one open end, said peripheral cutting bars of said second crushing drum being spaced apart by entry slots open into said second drum cavity.

28. A crushing apparatus as set forth in claim 27, wherein said means further comprises each said entry slot increasing in size in a radial direction of said second crushing drum towards the respective said drum cavity.

29. A crushing apparatus as set forth in claim 27, wherein said means further comprises each cutting bar having a width and each entry slot having a width approximately corresponding to said width of said cutting bar.

30. A crushing apparatus as set forth in claim 27, further comprising clearing means provided in said drum cavity of at least one of said first and second crushing drums for clearing the non-crushed or only partially crushed material toward said open end thereof.

31. A crushing apparatus as set forth in claim 30, wherein said clearing means comprises a plate which is curved parallel to the periphery of the respective said crushing drum and which has at least one clearing edge which is operative towards said open end thereof.

32. A crushing apparatus as set forth in claim 30, wherein said clearing means comprises a helically wound web.

33. A crushing apparatus as set forth in claim 30, wherein said clearing means projects out of the respective said drum cavity and is fixed to said housing.

34. A crushing apparatus as set forth in claim 18, further comprising clearing means provided in said drum cavity for clearing the non-crushed or only partially crushed material towards said open end.

35. A crushing apparatus as set forth in claim 34, wherein said clearing means projects out of said drum cavity and is fixed to said housing.

36. A crushing apparatus as set forth in claim 34, wherein said clearing means comprises a plate which is curved parallel to the periphery of said crushing drum and which has at least one clearing edge which is operative towards said open end.

37. A crushing apparatus as set forth in claim 34, wherein said clearing means comprises a helically wound web.

* * * * *

UNITED STATES PATENT AND TRADEMARK OFFICE

CERTIFICATE OF CORRECTION

PATENT NO. : 5,470,023

DATED : November 28, 1995

INVENTOR(S) : Falkner

It is certified that error appears in the above-indentified patent and that said Letters Patent is hereby corrected as shown below:

On the title page: Item

[73], change "Australia" to —Germany

Signed and Sealed this

Twenty-eighth Day of May, 1996

*Attest:*

BRUCE LEHMAN

*Attesting Officer*

*Commissioner of Patents and Trademarks*